US009922785B2

(12) United States Patent
Jur et al.

(10) Patent No.: US 9,922,785 B2
(45) Date of Patent: Mar. 20, 2018

(54) SAFETY SWITCH HAVING INTERLOCKING HANDLE AND DOOR

(71) Applicant: Eaton Corporation, Cleveland, OH (US)

(72) Inventors: Arthur James Jur, Cleveland, TN (US); James Windelon Adams, Chatsworth, GA (US); Brian Scott Bradley, Cleveland, TN (US); Nicholas Emmett Klus, Cleveland, TN (US); John Powell Hendrix, Cleveland, TN (US); Douglas Ray Bender, Cleveland, TN (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/198,894

(22) Filed: Jun. 30, 2016

(65) Prior Publication Data

US 2017/0004940 A1 Jan. 5, 2017

Related U.S. Application Data

(60) Provisional application No. 62/188,209, filed on Jul. 2, 2015.

(51) Int. Cl.

| | |
|---|---|
| ***H01H 9/20*** | (2006.01) |
| ***H01H 21/06*** | (2006.01) |
| *H01H 9/10* | (2006.01) |
| *H01H 9/22* | (2006.01) |

(52) U.S. Cl.
CPC ..... *H01H 21/06* (2013.01); *H01H 9/104* (2013.01); *H01H 9/226* (2013.01)

(58) Field of Classification Search
CPC ..... H01H 9/22; H01H 9/226; H01H 9/24
USPC ..... 200/50.13, 50.02, 50.03, 50.04, 50.12, 200/50.18, 50.19
See application file for complete search history.

(56) References Cited

U.S. PATENT DOCUMENTS

| | | | | |
|---|---|---|---|---|
| 3,632,917 A * | 1/1972 | Norden | H01H 3/32 200/43.14 |
| 6,373,009 B1 | 4/2002 | Prohaska et al. | |
| 7,348,510 B1 | 3/2008 | Foley et al. | |
| 7,450,369 B2 | 11/2008 | Wilkie, II et al. | |
| 7,531,761 B2 | 5/2009 | Carson et al. | |
| 8,254,089 B2 * | 8/2012 | Cosley | H02B 1/32 200/50.32 |

* cited by examiner

*Primary Examiner* — Vanessa Girardi
(74) *Attorney, Agent, or Firm* — Myers Bigel, P.A.

(57) ABSTRACT

A safety switch includes a housing including first and second compartments that are separated by a barrier, a switch mechanism in the first compartment, one or more fuse holders in the second compartment, a first door connected to the housing and covering the first compartment, a second door connected to the housing, a handle connected to the switch mechanism, and a locking mechanism operatively connected to the handle. The handle is movable between an off position and an on position. The locking mechanism configured such that: the second door is locked in a closed position when the handle is in the on position; the second door is movable from the closed position to an open position to expose the second compartment when the handle is in the off position; and the handle is locked in the off position when the second door is in the open position.

19 Claims, 12 Drawing Sheets

SAFETY SWITCH HAVING INTERLOCKING HANDLE AND DOOR

RELATED APPLICATIONS

This application claims priority to U.S. Provisional Application No. 62/188,209, filed Jul. 2, 2015, the disclosure of which is incorporated by reference in its entirety.

BACKGROUND

Safety switches are used in electrical power distribution systems to electrically isolate a load or a portion of a power circuit.

Purchasers and installers of electrical equipment are increasingly interested in the safety of those using the equipment. Standards have been introduced in an effort to reduce the exposure of individuals to live power over 48 Vac.

Safety switches typically include fuses behind a door. When a fuse clears (opens), the fuse must be replaced. The door of the safety switch must be opened to replace the fuse. The door of the safety switch may be interlocked such that the switch must be in the "OFF" position in order to open the door. However, the line side of the switch may not be disconnected from live voltage. Therefore, the individual replacing the fuse(s) may be exposed to live power which may be over 120 Vac.

SUMMARY

Some embodiments of the invention are directed to a safety switch. The safety switch includes a housing including first and second compartments that are separated by a barrier, a switch mechanism in the first compartment, one or more fuse holders in the second compartment, a first door connected to the housing and covering the first compartment, a second door connected to the housing, a handle connected to the switch mechanism, and a locking mechanism operatively connected to the handle. The second door covers the second compartment in a closed position. The handle is movable between an off position and an on position. The locking mechanism is configured such that: the second door is locked in the closed position when the handle is in the on position; the second door is movable from the closed position to an open position to expose the second compartment when the handle is in the off position; and the handle is locked in the off position when the second door is in the open position.

According to some embodiments, the safety switch includes a switch assembly in the first compartment, one or more fuses in the second compartment and held by the one or more fuse holders, and one or more conductors electrically connecting the switch assembly and the one or more fuses. The conductors may extend through at least one opening in the barrier.

According to some embodiments, an enclosed plenum is adjacent or in the second compartment and extends toward the barrier. The plenum may be configured to receive line side conductors therethrough for connection to the switch assembly in the first compartment.

According to some embodiments, the locking mechanism includes an elongated linkage operatively connected to the handle such that the linkage translates in response to movement of the handle. The linkage may include first and second opposite ends. The first end may be operatively connected to the handle and the second end may be received in a linkage receiving member in the second compartment when the second door is in the closed position and the handle is moved from the off position to the on position to thereby lock the second door in the closed position.

The linkage receiving member may include a bracket having an aperture. The bracket may be spring-loaded and movable between a first position when the second door is in the closed position and a second position when the second door is in the open position. The linkage may define a longitudinal axis. The aperture may be aligned with the longitudinal axis with the bracket in the first position and the aperture may not be aligned with the longitudinal axis with the bracket in the second position. The bracket may include a plate with the aperture defined in the plate. The second end of the linkage may contact the plate when the second door is in the open position and a user attempts to move the handle from the off position to the on position.

According to some embodiments, the linkage extends through an opening in the barrier.

According to some embodiments, the housing includes a back wall, an upper wall, a lower wall, and opposite first and second sidewalls. The first compartment may be defined by the back wall, the upper wall, the barrier, and the first and second sidewalls. The second compartment may be defined by the back wall, the lower wall, the barrier, and the first and second sidewalls. The first and second doors may be pivotally connected to the first sidewall and the handle may be connected to the second sidewall.

According to some embodiments, the first door is locked in a closed position by a fastener and/or a clamp.

According to some embodiments, the second door covers the second compartment and the first door in the closed position.

Some other embodiments of the invention are directed to a method including providing a safety switch including a housing including first and second compartments that are separated by a barrier, a switch mechanism in the first compartment, at least one fuse holder in the second compartment, a handle coupled to the switch mechanism that is movable between an off position and an on position, a first door coupled to the housing and covering the first compartment, a second door coupled to the housing, and a locking mechanism in the housing. The at least one fuse holder holds at least one fuse. The second door covers the second compartment in a closed position. The locking mechanism locks the second door in the closed position with the handle in the on position. The method includes: moving the handle from the on position to the off position with the second door in the closed position; unlocking the second door in response to moving the handle from the on position to the off position; opening the unlocked second door; and replacing the at least one fuse in the second compartment.

According to some embodiments, the method includes locking the handle in the off position in response to opening the second door.

According to some embodiments, the method includes, after replacing the at least one fuse: closing the second door to the closed position; moving the handle from the off position to the on position with the second door in the closed position; and locking the second door in the closed position in response to moving the handle from the off position to the on position.

According to some embodiments, the locking mechanism includes a linkage operatively connected to the handle and a linkage receiving member in the second compartment. Locking the second door in the closed position may include receiving the linkage in the linkage receiving member in response to moving the handle from the off position to the on position. Unlocking the second door may include withdrawing the linkage from the linkage receiving member in response to moving the handle from the on position to the off position. The linkage receiving member may be movable between a first position and a second position, and the linkage receiving member may move from the first position to the second position in response to opening the second door.

Some other embodiments of the invention are directed to a safety switch. The safety switch includes a housing including first and second compartments that are separated by a barrier, a switch assembly and a switch mechanism in the first compartment, a plurality of fuses in the second compartment, a plurality of conductors electrically connecting the switch assembly and the plurality of fuses, a first door connected to the housing and locked in a closed position to cover the first compartment, a second door connected to the housing, a handle connected to the switch mechanism, and a locking mechanism operatively connected to the handle. The plurality of conductors extend through at least one opening in the barrier. The second door covers the second compartment in a closed position. The locking mechanism is configured such that: the second door is locked in the closed position when the handle is in the on position; the second door is unlocked and movable from the closed position to an open position to expose the second compartment when the handle is in the off position; the first door remains locked in the closed position when the handle is in the off position; and the handle is locked in the off position when the second door is in the open position.

Further features, advantages and details of the invention will be appreciated by those of ordinary skill in the art from a reading of the figures and the detailed description of the preferred embodiments that follow, such description being merely illustrative of the invention.

DETAILED DESCRIPTION OF EMBODIMENTS OF THE INVENTION

Figure 1:
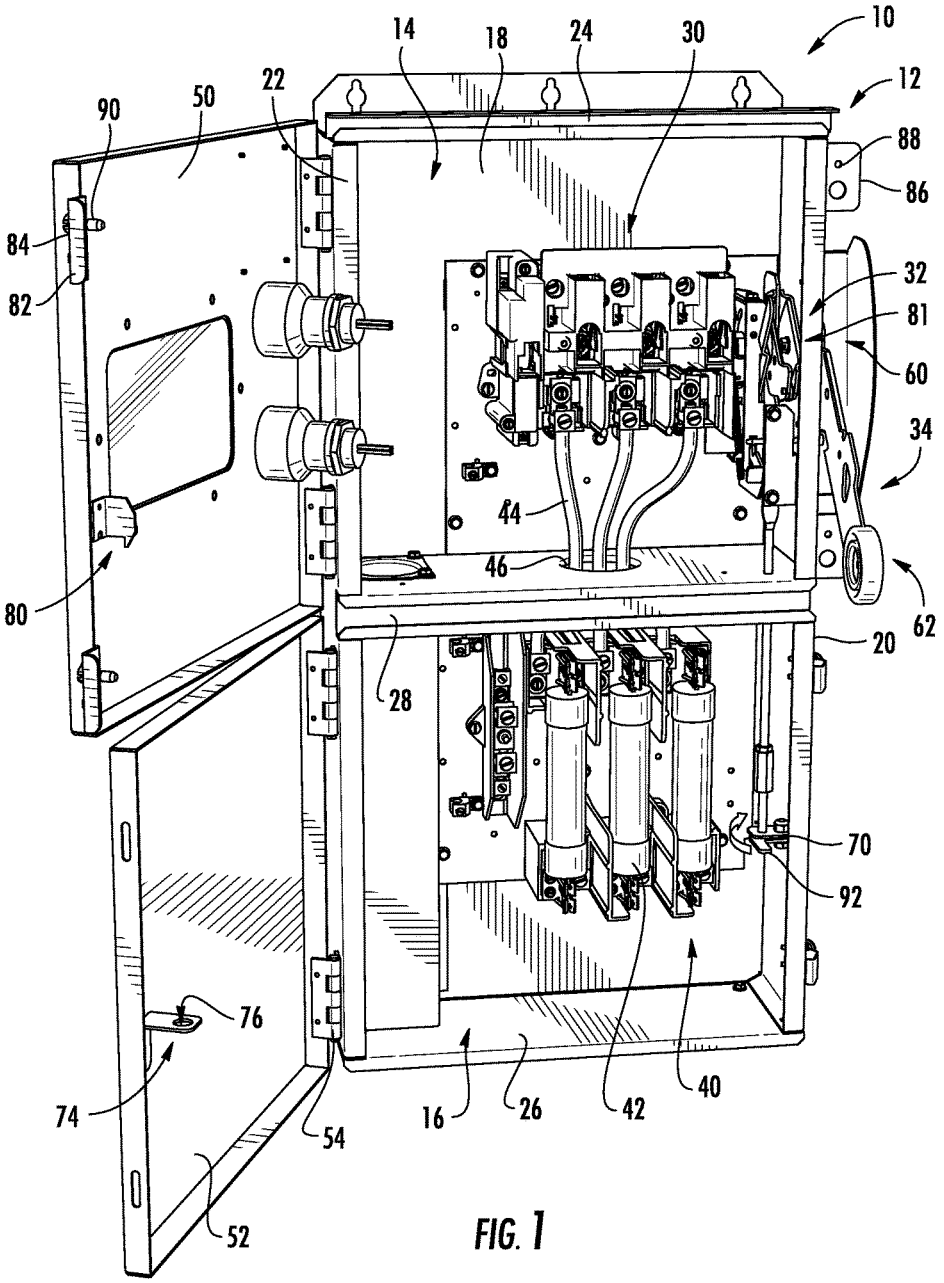
FIG. 1 is a front perspective view of a safety switch including first and second doors in an open position according to some embodiments.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "includes," "comprising," and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

A safety switch 10 according to some embodiments is illustrated in FIG. 1. The safety switch 10 includes an enclosure or housing 12. The housing 12 includes first and second compartments 14, 16.

The housing 12 includes a back panel 18. Opposing sidewalls 20, 22 and opposing upper and lower walls 24, 26 extend outwardly from the back panel 18. Also extending outwardly from the back panel 18 is a central or interior wall or barrier 28. The central or interior wall 28 may be grounded to the housing 12. The central wall 28 may be perpendicular to the back panel or wall 28.

The first compartment 14 is defined by the back panel 18, the sidewalls 20, 22, the upper wall 24 and the central panel or wall 28 of the housing 12. The second compartment 16 is defined by the back panel 18, the sidewalls 20, 22, the lower wall 26 and the central wall 28 of the housing 12. The central or interior wall 28 divides the housing 12 into the first and second compartments 14, 16. The first and second compartments 14, 16 may have the same depth or substantially the same depth in a direction perpendicular to the back panel 18. In some embodiments, the second compartment 16 may have a height that is equal to that of the first compartment 14. In some other embodiments, the second compartment 16 may have a height that is greater than that of the first compartment 14.

A switch assembly 30 including a plurality of contacts is mounted in the first compartment 14. Also in the first compartment 14 is a switch mechanism 32 that is configured to open and close the contacts. The switch mechanism 32 is coupled to an operating handle 34.

A plurality of fuse holders 40 are mounted in the second compartment 16 (e.g., connected to the back wall 18 of the housing 12). Each fuse holder 40 is configured to hold a fuse 42.

A plurality of conductors 44 extend between the switch assembly 30 in the first compartment 14 and the fuses 42 in the second compartment 16. The conductors 44 extend through an aperture or passageway 46 formed in the central wall 28 of the housing 12. The conductors 44 electrically connect the switch assembly 30 and the fuses 42. The conductors 44 are sized to carry the necessary current from the load side of the switch assembly 30 in the first compartment 14 to the line side of the fuses 42 in the second compartment 16.

As understood by those skilled in the art, line side conductors may be received in the first compartment 14 and connected to the line side of the switch assembly 30. For example, a hole may be drilled or otherwise formed in the upper wall 24 and the line side conductors may be received through the hole and connected to the switch assembly 30. The line side conductors may provide power from a primary or secondary power source. As also understood by those skilled in the art, load side conductors may extend from the load side of the fuses 42 and exit the second compartment 16 to connect to equipment to power the equipment. For example, a hole may be drilled or otherwise formed in the lower wall 26 and the load side conductors may exit the hole, so they can be connected to the equipment. As will be described in more detail below, the present invention places the fuses 42 in the second compartment 16 that is isolated from the first compartment 14 and from the line side conductors and the switch assembly 30. In this regard, a user can safely replace the fuses 42 without being exposed to the line side conductors and/or the switch assembly 30 which may be connected to live voltage even when the handle 34 is in an "OFF" position.

Figure 2:
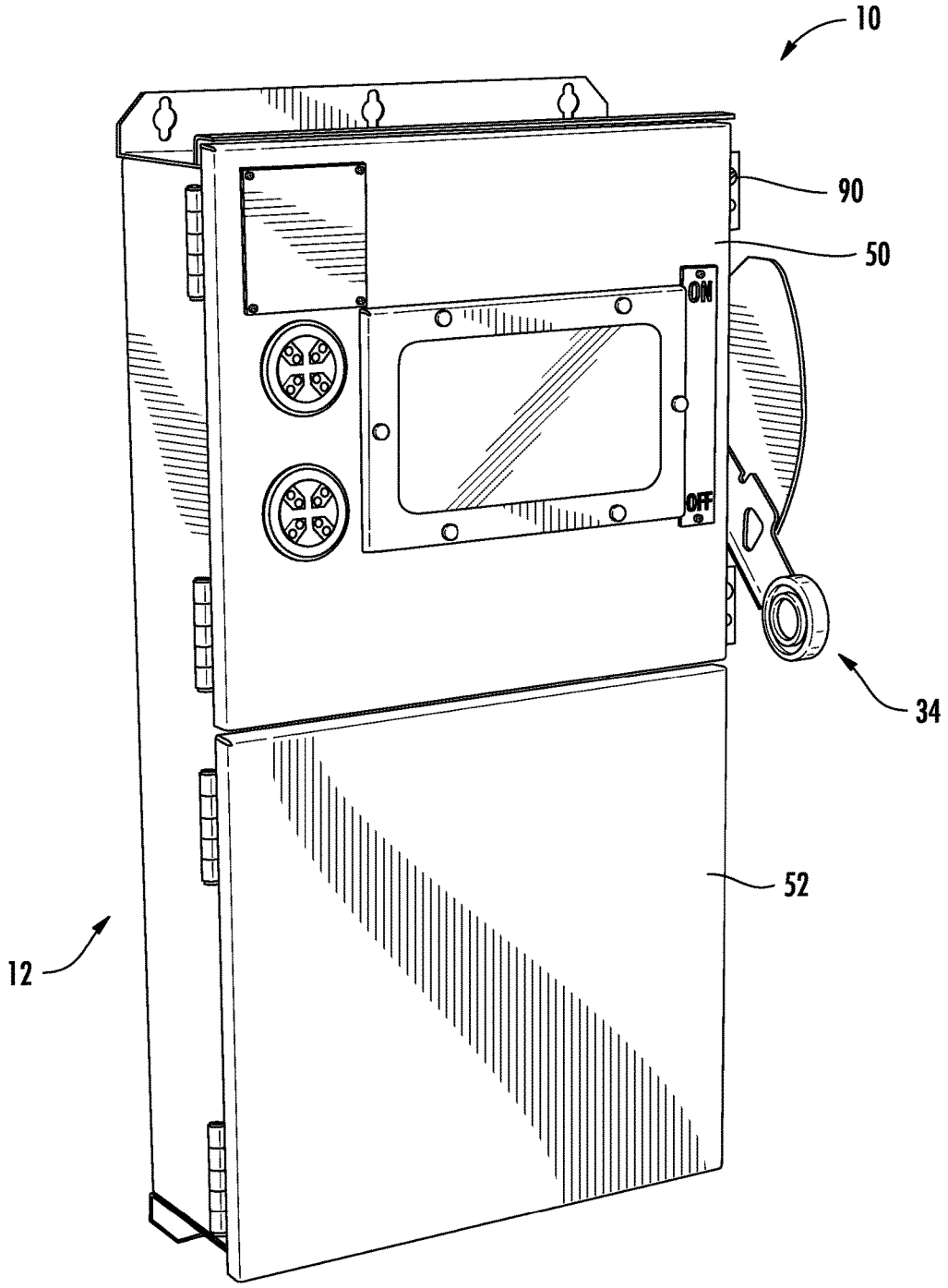
FIG. 2 is a front perspective view of the safety switch of FIG. 1 with the first and second doors in a closed position.

First and second covers or doors 50, 52 are pivotably coupled to the sidewall 22 of the housing 12 (e.g., by hinges 54). The first door 50 is sized and configured to cover the first compartment 14 of the housing 12 and the second door 52 is sized and configured to cover the second compartment 16 of the housing 12. The doors 50, 52 are shown in an open position in FIG. 1 and in a closed position in FIG. 2. As will be described in more detail below, the second door 52 is movable from the closed position to the open position only when the operating handle 34 is in the "OFF" position.

Figure 3:
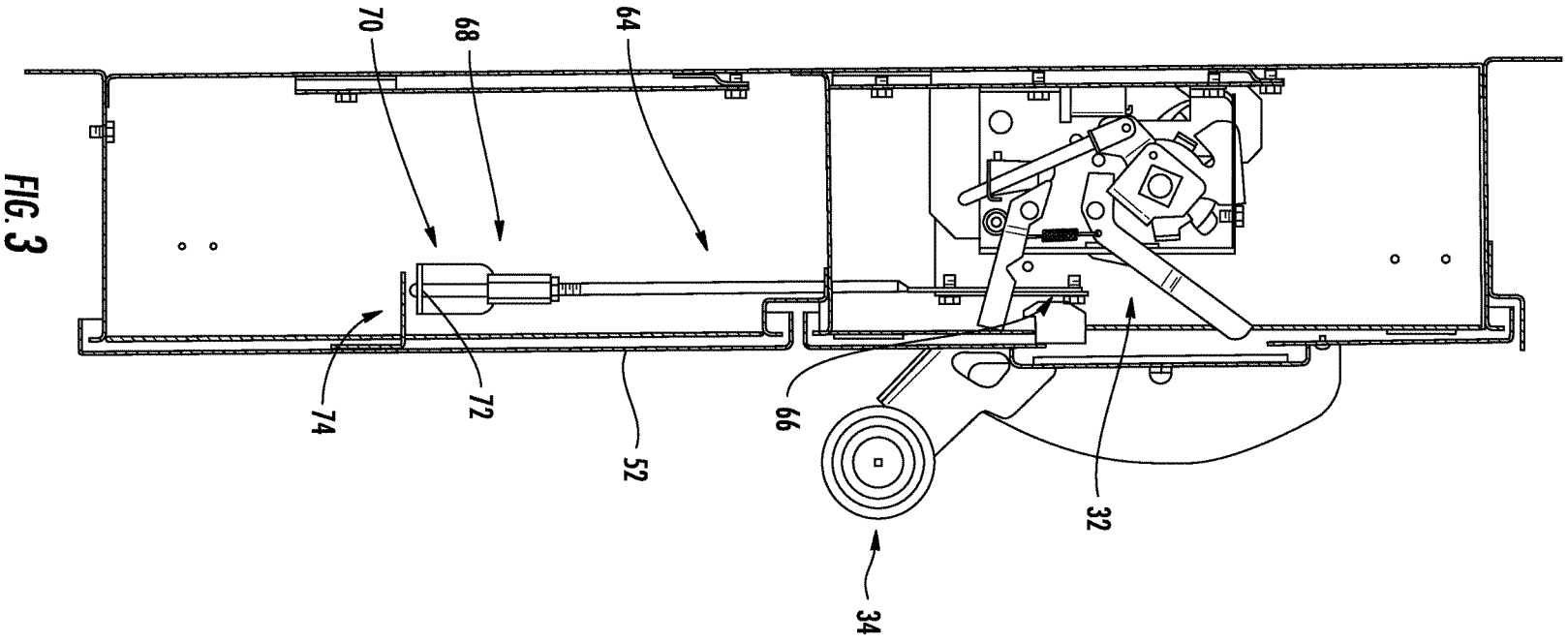
FIG. 3 is a side sectional view of the safety switch of FIG. 1 with an operating handle thereof in an "OFF" position.
Figure 4A:
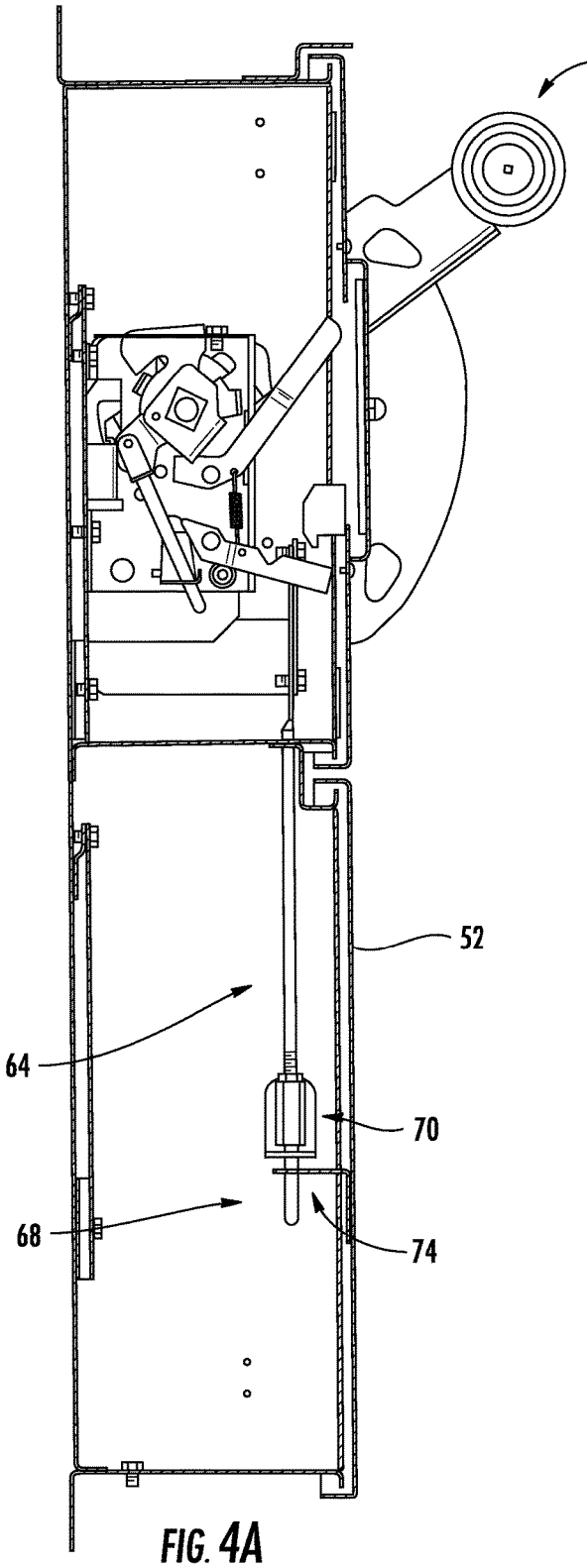
FIG. 4A is a side sectional view of the safety switch of FIG. 1 with the operating handle thereof in an "ON" position.
Figure 4B:
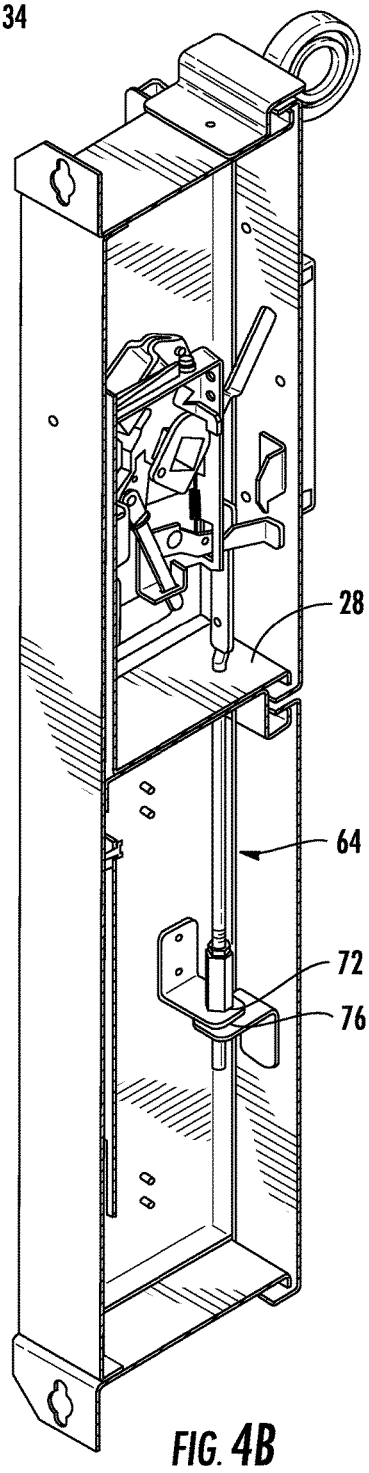
FIG. 4B is a perspective sectional view of the safety switch of FIG. 1 with the operating handle thereof in the "ON" position.

The operating handle 34 has a first end 60 pivotably coupled to the switch mechanism 32 and a second, opposite end 62 that can be operated (e.g., rotated) by a user. Referring to FIGS. 3 and 4, a linkage 64 has a first end or first end portion 66 and a second, opposite end or second end portion 68. The first end 66 of the linkage 64 is configured to be coupled to the switch mechanism 32 and/or the handle 34 such that movement of the handle 34 results in corresponding movement of the second end 68 of the linkage 64.

A first bracket 70 is mounted to the housing 12 (e.g., the bracket 70 may be mounted to the sidewall 20 as shown in FIG. 1). An aperture 72 is defined in the first bracket 70 through which the second end 68 of the linkage 64 may extend. Referring to FIG. 1, a second bracket 74 is mounted to the second door 52. An aperture 76 is defined in the second bracket 74.

Referring to FIGS. 3 and 4, with the second door 52 in the closed position, the apertures 72, 76 of the first and second brackets 70, 74 align. The second end 68 of the linkage 64 extends through the apertures 72, 76 when the handle 34 is in the "ON" position (FIG. 4). The second door 52 is thereby locked and a user is prevented from opening the second door 52. When the handle 34 is moved to the "OFF" position, the second end 68 of the linkage 64 is withdrawn from the aperture 76 of the second bracket and a user can open the second door 52 (FIG. 3).

The safety switch 10 may include one or more features to prevent the switch from being energized when the lower door 52 is in the open position. For example, referring to FIG. 1, a spring loaded member or plate 92 may be mounted to the housing 12 adjacent the first bracket 70. The spring loaded member 92 may be biased such that, when the second door 52 is in the open position, the member 92 resides below the first bracket 70 and prevents the linkage 64 from extending downward if a user tries to move the handle 34 to the "ON" position. When the lower door 52 is closed, the second bracket 74 may contact the spring loaded member 92 which may then rotate out of the way as indicated by the arrow (i.e., the member 92 no longer underlies the first bracket 70 and/or the aperture 72 defined therein). The user can then move the handle to the "ON" position and the second end portion 68 of the linkage 64 extends through the aperture 76 defined in the second bracket 74.

Referring to FIG. 1, the first door 50 may include a latching feature 80 such as a protrusion that may interact with a latching feature of the housing 12 and/or the switch mechanism 32 such as a receptacle. The latching features may lock the first door 50 in the closed position when the handle 34 is in the "ON" position and/or the "OFF" position.

The first door 50 may also include one or more tabs 82 with each tab 82 having an aperture 84 defined therein. One or more tabs 86 may extend from the sidewall 20 of the housing 12 with an aperture 88 defined in each tab 86. The apertures 84, 88 of corresponding tabs 82, 86 may align with the first door 50 in the closed position. A fastener 90 may be received through the aligned apertures 84, 88. In this regard, the first door 50 may remain locked when the handle 34 is moved to the "OFF" position (if the latching features described above do not continue to lock the first door 50 in the closed position). If necessary, a user may open the first door 50 by removing the fasteners 90.

Safety switches according to embodiments described herein include a single housing with two separated compartments. Each compartment may have a separate door. Both doors may be locked by a linkage when the handle is in the "ON" position. The two compartments may separate the live voltage from the disconnected load when the handle is in the "OFF" position. The door covering the compartment holding the fuses may be opened when the handle is in the "OFF" position. The door covering the switch assembly remains locked which separates the individual from live power when replacing the fuses.

It will be appreciated that the housing 12 could have any suitable alternative configuration of compartments and/or doors. For example and without limitation, rather than being arranged in the over and under configuration shown in FIGS. 1 and 2, the first and second compartments 14, 16 could alternatively be disposed side-by-side. In addition, the second compartment could be on top of the first compartment. In other words, the compartment housing the fuses could be above the compartment housing the switch assembly and/or the switch mechanism. The top compartment would then be interlocked as described herein.

Figure 5:
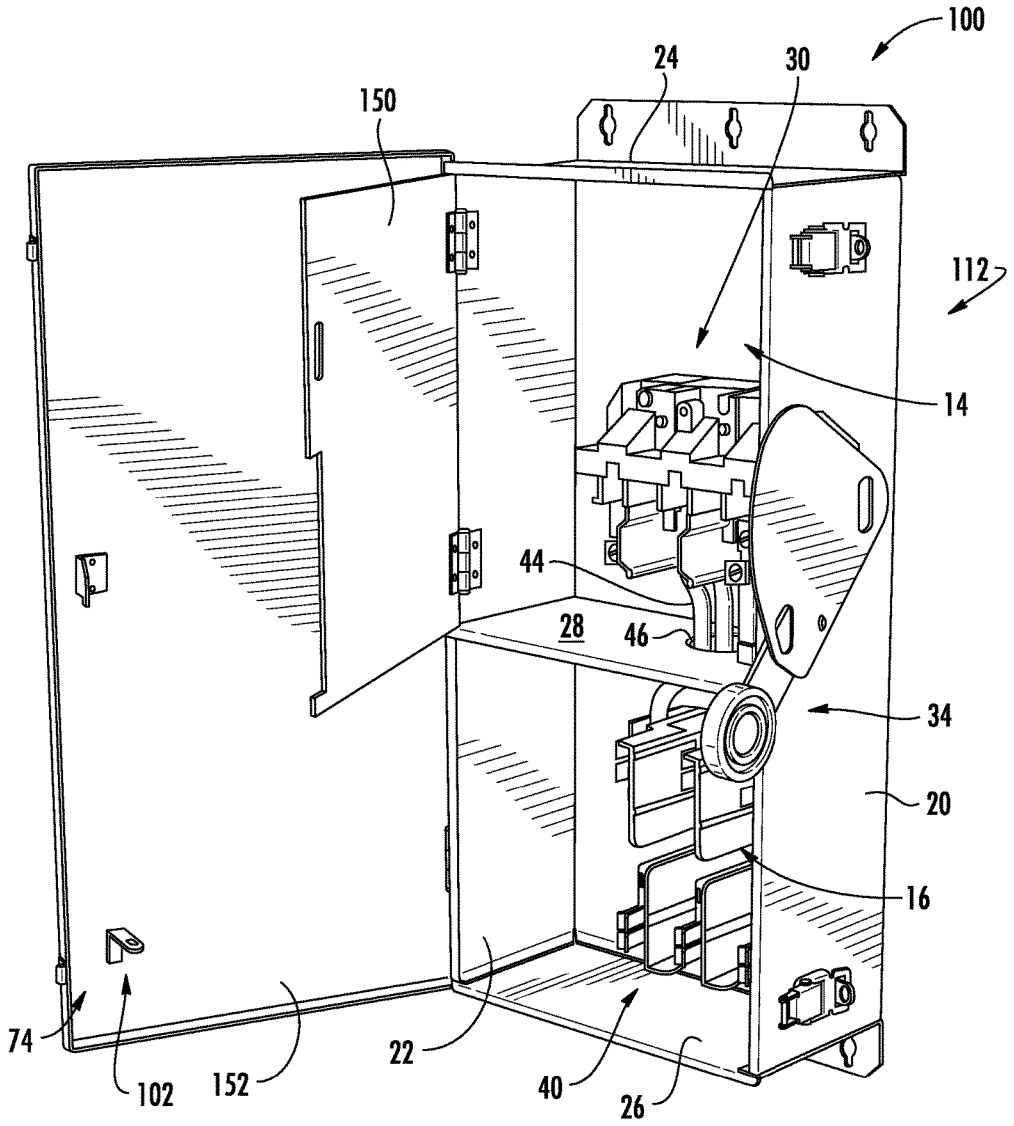
FIG. 5 is a perspective view of a safety switch including first and second doors in an open position according to some other embodiments.

A safety switch 100 according to some other embodiments is illustrated in FIG. 5. The safety switch 100 includes many of the same or similar features as the safety switch 10 described above. The primary differences will be described below.

The safety switch 100 includes a housing 112 having the first and second compartments 14, 16 as described above. The safety switch 100 includes first and second doors 150, 152 that are pivotably coupled to the housing 112. The first (or inner) door 150 is sized and configured to cover the first compartment 14 in the closed position (the first door is shown in the open position in FIG. 5). The second (or outer) door 152 is sized and configured to cover the first door 150 and the second compartment 16 in the closed position (the second door 152 is shown in the open position in FIG. 5).

Both doors 150, 152 are configured to remain locked when the operating handle 34 is in the "ON" position. The first door 150 is configured to remain locked and the second door 152 is configured such that a user can open the second door 152 when the handle 34 is moved to the "OFF" position. The safety switch 100 may include locking features such as those described above in reference to the safety switch 10. For example, a bracket or the like may be mounted to the second door 152 at the area 102 and a linkage assembly may engage the bracket when the handle is moved to the "ON" position to thereby lock the second door 152 in the closed position.

Figure 6:
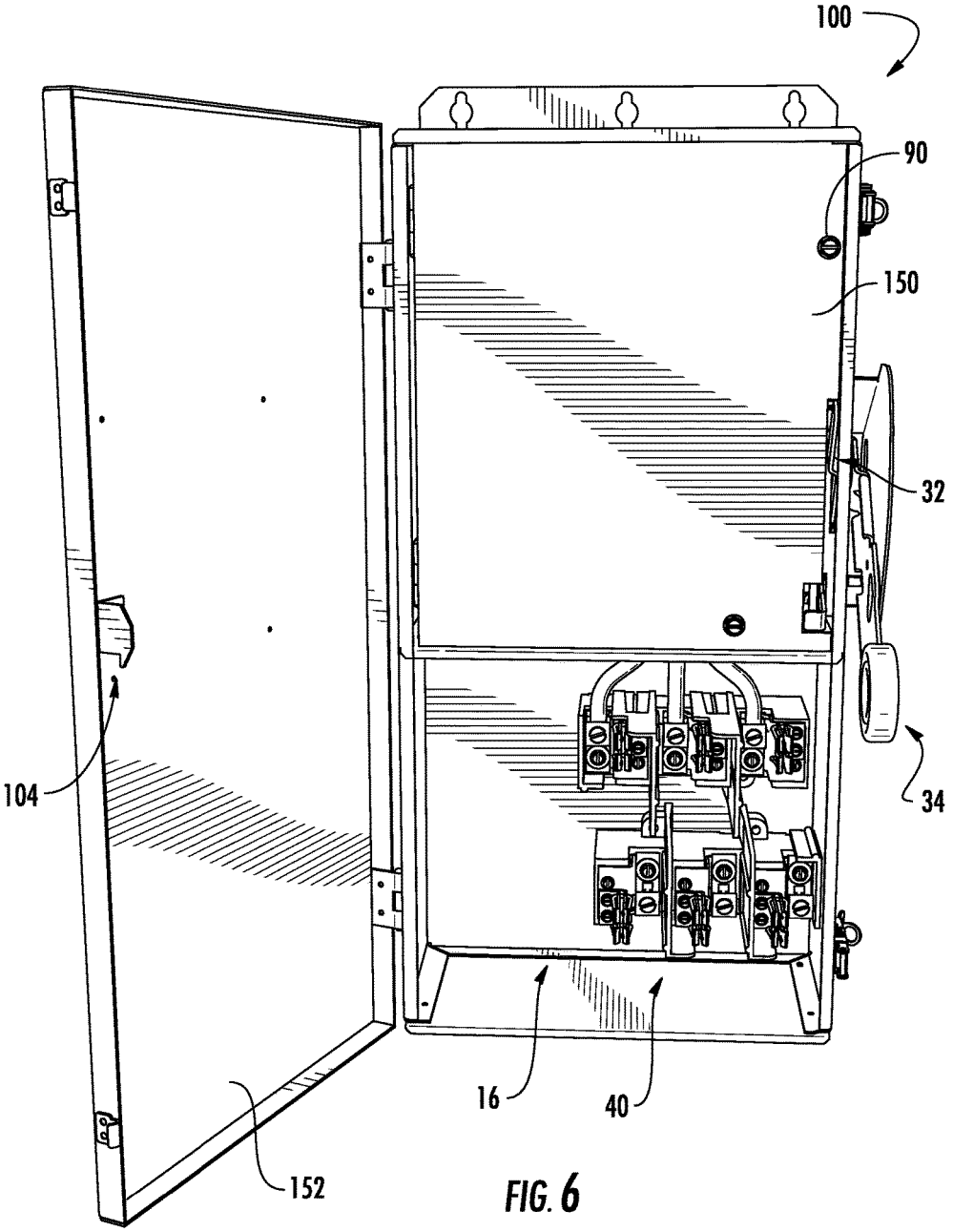
FIG. 6 is a front perspective view of the safety switch of FIG. 5 with the first door in a closed position and the second door in the open position.

Alternatively, and referring to FIG. 6, the second door 152 may include a latching feature 104 (e.g., a protrusion) that is configured to engage a latching feature of the housing 112 and/or the switch mechanism 32 (e.g., a receptacle). The latching features may disengage when the operating handle 34 is moved to the "OFF" position. The first door 150 may be held in the closed position by one or more fasteners 90 and/or by an additional locking feature when the handle 34 is in the "OFF" position.

It will be appreciated that the alternative embodiment illustrated in FIGS. 5 and 6 also effectively segregates the fuse holders 40 in the second compartment 16 from the switch assembly 30 and other components in the first compartment 14. In this sense, with the operating handle 34 in the "OFF" position, a user may open the second door 152 and safely access and/or replace fuses in the second compartment 16 while the first door 150 remains locked and covers the first compartment 14.

Figure 7:
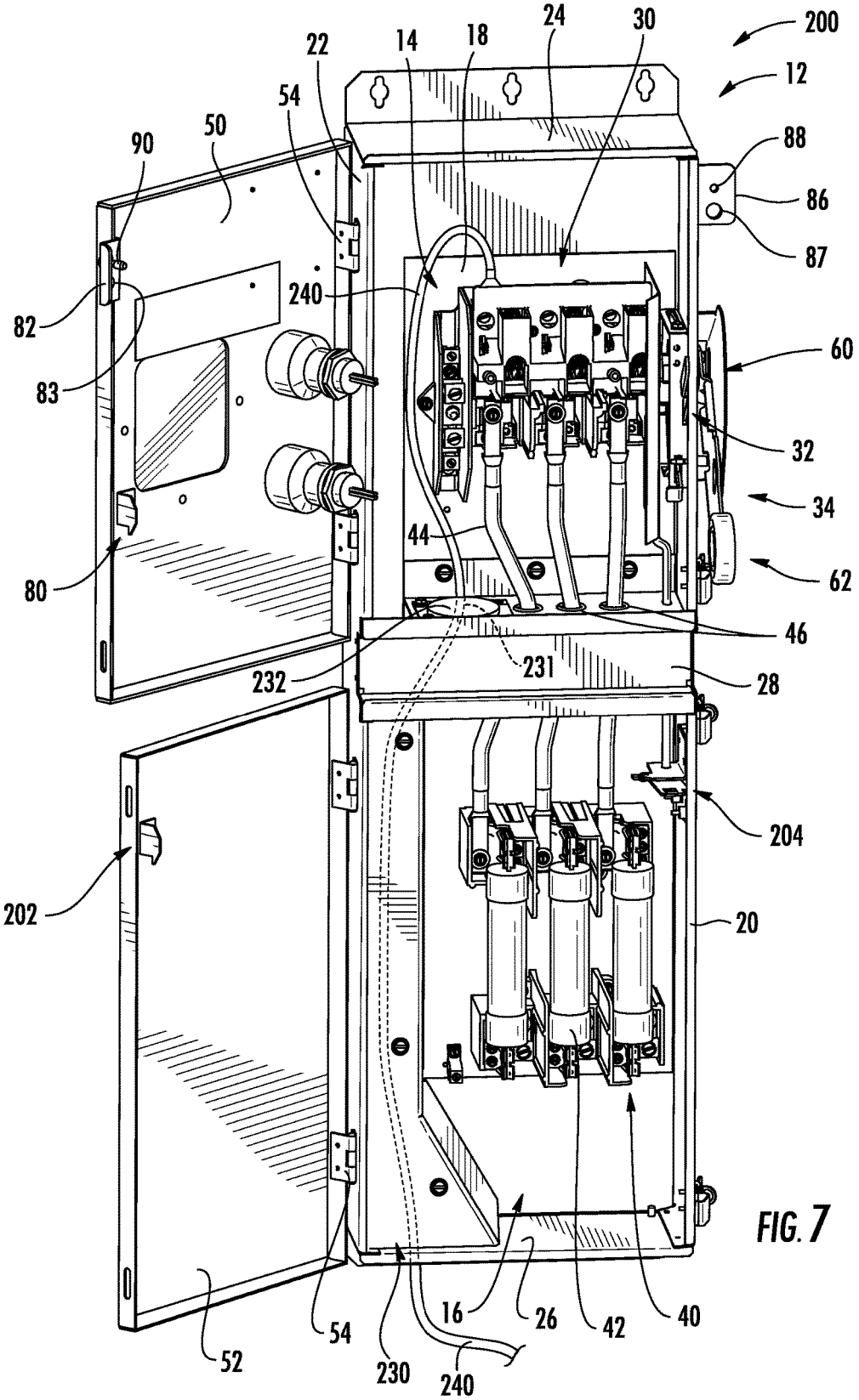
FIG. 7 is a front perspective view of a safety switch including first and second doors in an open position according to some embodiments.

A safety switch 200 according to some other embodiments is illustrated in FIG. 7. The safety switch 200 includes many of the same or similar features as the safety switch 10 described above. The primary differences will be described below.

The safety switch 200 includes a locking mechanism 204. According to some embodiments, the locking mechanism 204 is configured to lock the second door 52 in the closed position when the handle 34 is in the "ON" position. According to some embodiments, the locking mechanism 204 is configured to prevent a user from moving the handle 34 from the "OFF" position to the "ON" position when the second door 52 is in the open position (e.g., the locking mechanism 204 is configured to lock the handle in the "OFF" position when the second door 52 is in the open position). Therefore, the locking mechanism 204 may be configured to provide similar functionality as the locking mechanism of the safety switch 10 including the linkage 64, the first bracket 70, the second bracket 74 and/or the spring loaded member 92.

Referring to FIGS. 7 and 9-11, the locking mechanism 204 may include the linkage 64, a latching feature such as a hook 202, a first bracket 206 and a second bracket 210. The hook 202 is on the second door 52.

The first end 66 of the linkage 64 is connected or operatively connected to the handle 34. For example, the first end 66 of the linkage 64 may be connected to a bracket or plate 205 that is connected or operatively connected to the handle 34. In this regard, movement (e.g., rotation) of the handle 34 causes the plate 205 to move (e.g., rotate), which in turn causes the linkage 64 to translate. In particular, the second end 68 of the linkage 64 may translate (e.g., up and down) in response to movement (e.g., rotation) of the handle 34.

Figure 11A:
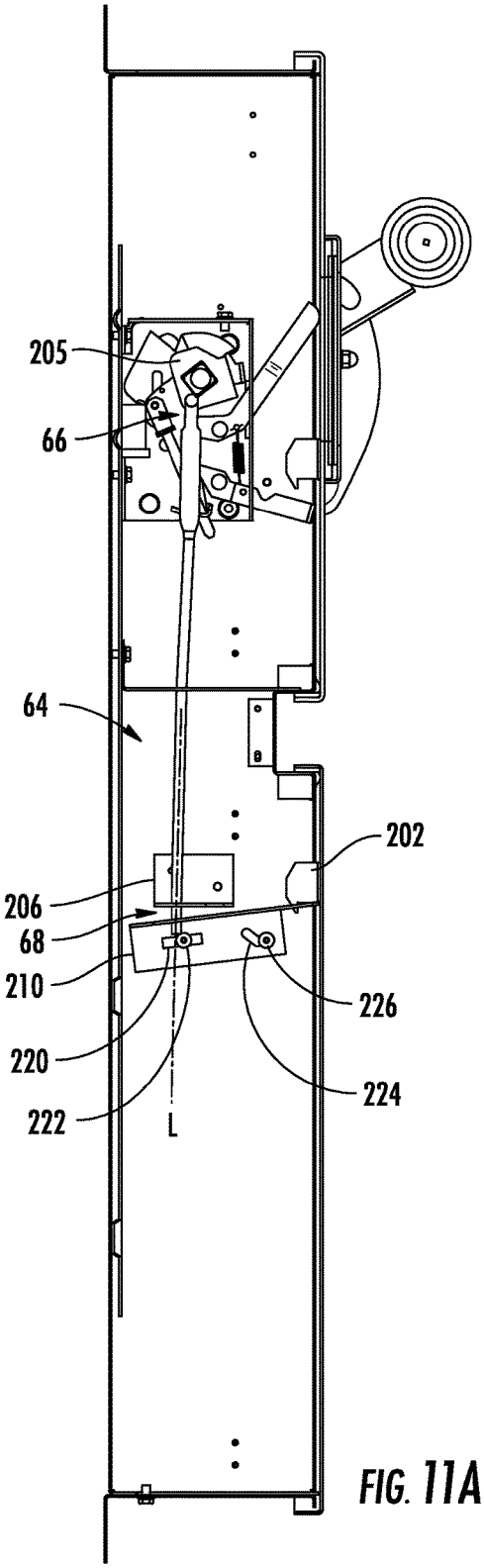
FIG. 11A is a side sectional view of the safety switch of FIG. 7 with the operating handle thereof in an "ON" position.
Figure 11B:
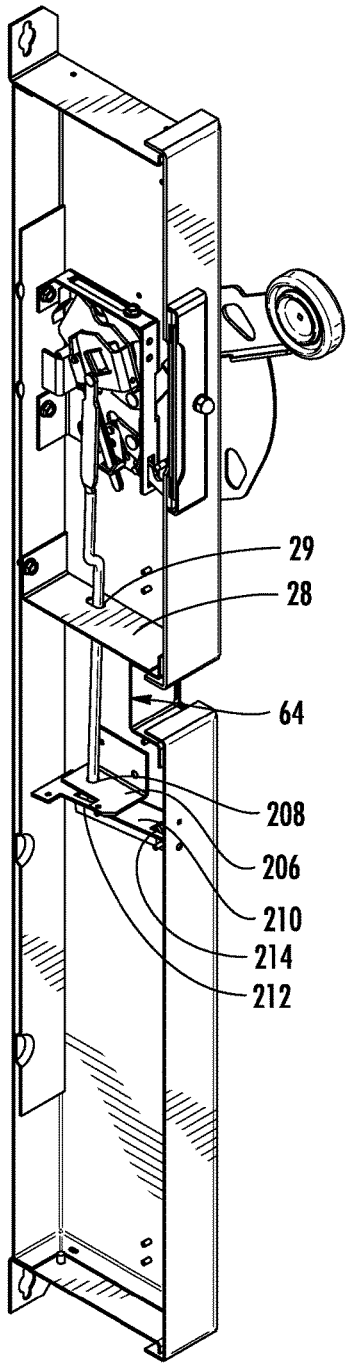
FIG. 11B is a perspective sectional view of the safety switch of FIG. 7 with the operating handle thereof in the "ON" position.

The linkage 64 may extend through an aperture 29 defined in the barrier 28 (FIG. 11B). The linkage may be or include a rod, shaft, tube or the like and may be bent and/or curved in at least one region thereof.

The first bracket 206 may be connected to the housing 12 such as at the first sidewall 20. An aperture 208 is defined in the first bracket 206 through which the second end 68 of the linkage 64 may extend.

The second bracket 210 (also referred to herein as a linkage receiving feature or member) may be generally L-shaped and have an upper surface or plate 211 and a side surface or plate 218. The second bracket 210 may be connected to the housing 12 such as at the first sidewall 20.

A first aperture 212 is defined in the upper surface 211 of the second bracket 210. Referring to FIG. 11, with the second door 52 in the closed position, the apertures 208 and 212 of the first and second brackets 206, 210 align. The second end 68 of the linkage 64 extends through the aligned apertures 208, 212 when the handle 34 is in the "ON" position. The second door 52 is thereby locked and a user is prevented from opening the second door 52.

A second aperture 214 is also defined in the upper surface 211 of the second bracket 210. The second aperture 214 is positioned and configured to receive the hook 202 when the second door 52 is in or moved to the closed position.

Figure 9:
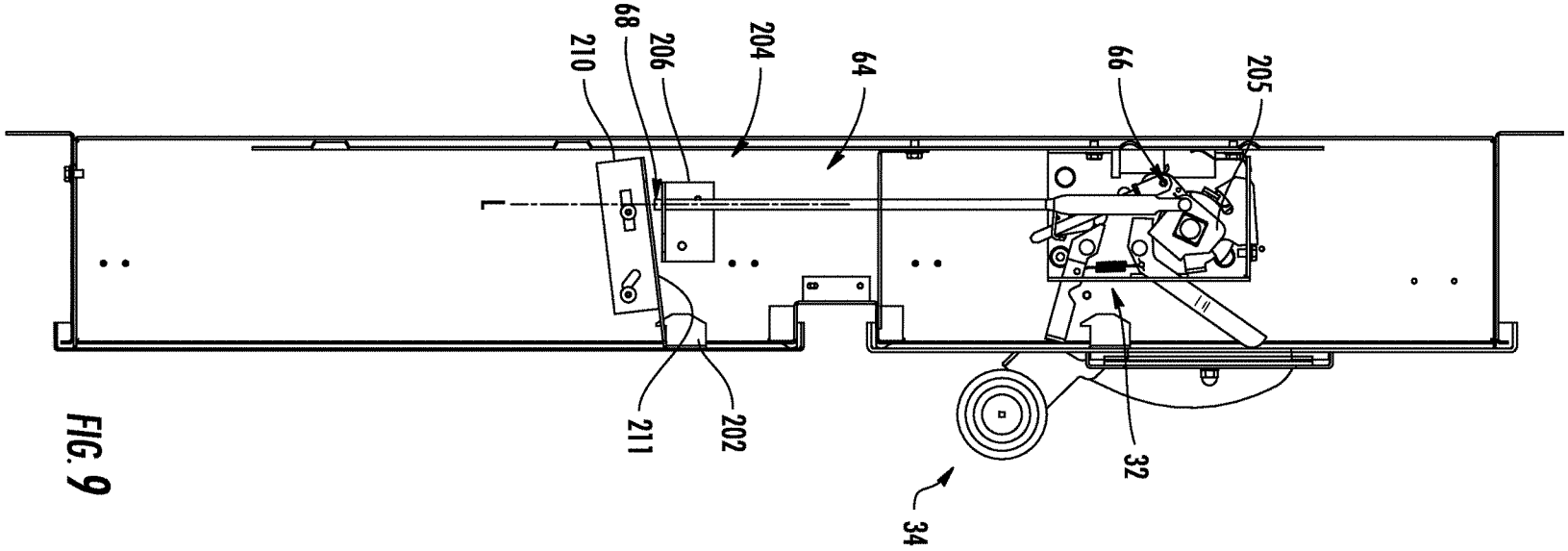
FIG. 9 is a side sectional view of the safety switch of FIG. 7 with an operating handle thereof in an "OFF" position.
Figure 10:
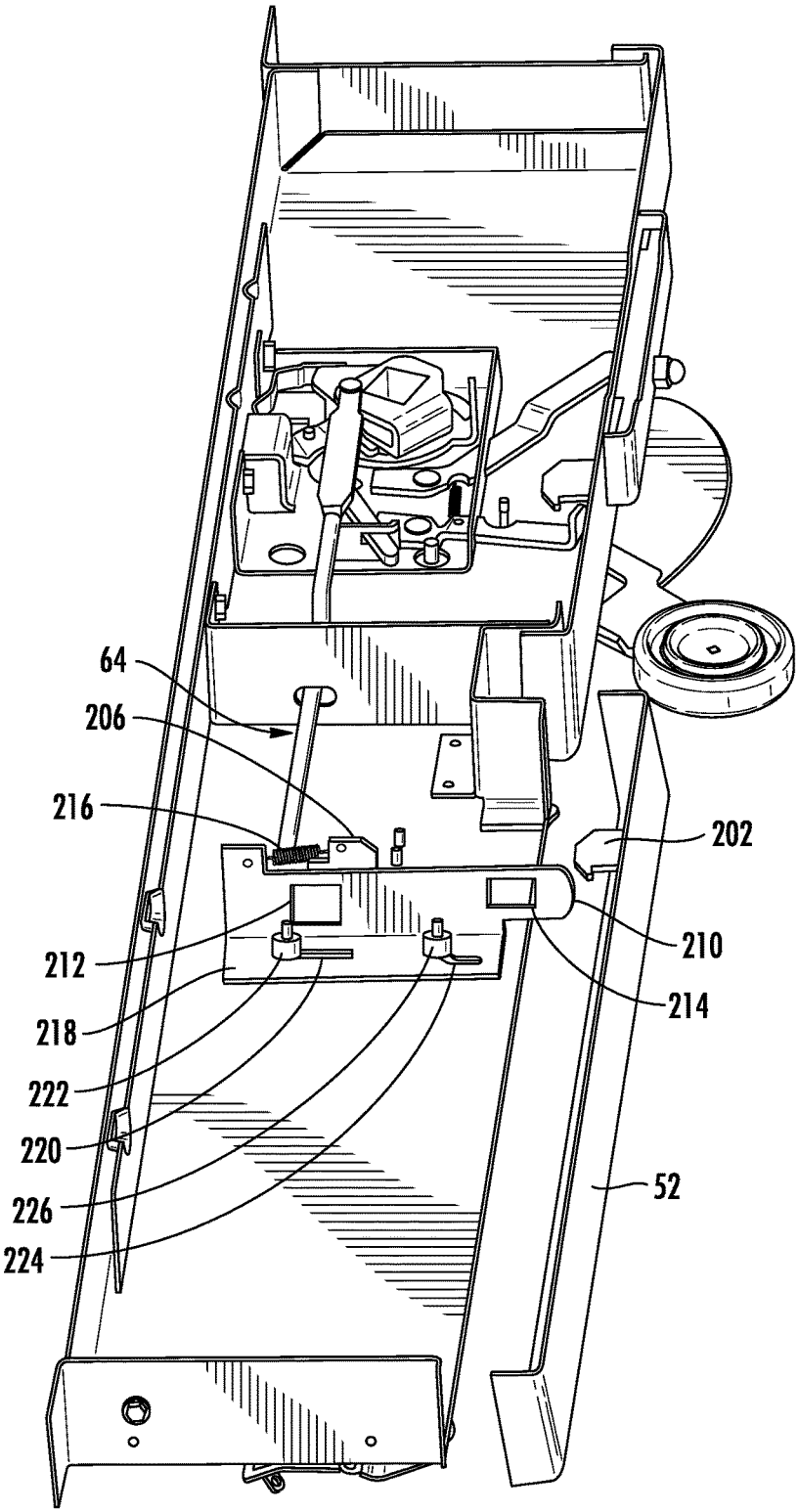
FIG. 10 is a perspective sectional view of the safety switch of FIG. 7 with the operating handle thereof in the "OFF" position and the second door in the open position according to some embodiments.

Referring to FIGS. 9 and 10, when the handle 34 is moved to the "OFF" position, the second end 68 of the linkage 64 is withdrawn from the first aperture 212 of the second bracket 210. A user may then open the second door 52 to access the second compartment 16 (FIG. 7).

The second bracket 210 may be spring-loaded. For example, referring to FIG. 10, a spring 216 may extend between the first bracket 206 and the second bracket 210. The second bracket 210 may move between a first position when the second door 52 is closed and the hook 202 is received in the aperture 214 (FIG. 9) and a second position when the second door 52 is open and the hook 202 is withdrawn from the aperture 214 (FIG. 10).

The spring 216 may bias the second bracket 210 toward the second position. First and second slots 220, 224 may be defined in the side surface 218 of the second bracket 210. Bushings or followers 222, 226 may be received and translate in the first and second slots 220, 224, respectively, to facilitate the movement of the second bracket 210 between the first and second positions.

According to some embodiments, an oblique angle is defined between the second bracket upper plate 211 and the second door 52 when the second bracket 210 is in the first position. According to some embodiments, the second bracket upper plate 211 is parallel or generally parallel to the barrier 28 when the second bracket 210 is in the second position.

When the handle 34 is moved to the "OFF" position and the second door 52 is in the open position, the second bracket 210 assumes the second position and the apertures 208, 212 of the first and second brackets 206, 210 are no longer aligned. As a result, the second end 68 of the linkage 64 does not extend through the aperture 212 of the second bracket 210 when a user attempts to move the handle 34 from the "OFF" position to the "ON" position when the second door 52 is open. Instead, the second end 68 of the linkage 64 abuts or "bottoms out" on the upper surface 211 of the second bracket 210. Therefore, the handle 34 is locked in the "OFF" position when the second door 52 is in the open position which prevents the switch 30 (FIG. 7) from being energized when the second door 52 is in the open position.

Put another way, the linkage 64 (or the portion of the linkage 64 including the second end 68) may define a longitudinal axis L (FIG. 9). The aperture 212 of the second bracket 210 is aligned (e.g., horizontally aligned) with the longitudinal axis when the second bracket 210 is in the first position and is not aligned (e.g., not horizontally aligned) with the longitudinal axis L when the second bracket 210 is in the second position. That is, the longitudinal axis L or an extension thereof may extend through the aperture 212 when the second bracket 210 is in the first position and may not extend through the aperture 212 when the second bracket 210 is in the second position.

Referring again to FIG. 7, an enclosed plenum 230 may be adjacent the second compartment 16. The plenum 230 may be used to route line side cables or conductors from the bottom of the housing 12, through an opening in the barrier 28 that is provided when a plug 232 is removed, and to the line side of the switch 30. This allows for bottom entry of the line side cables if desired. The plenum 230 isolates the line side cables from the second compartment 16 so that a user is not exposed to live power when working in the second compartment 16.

In more detail, one or more line conductors 240 may enter the plenum 230 from a hole in the lower wall 26 and be routed through the plenum 230, through an opening 231 in the barrier 28 that is exposed when the plug 232 is removed, and connected to the line side of the switch assembly 30. This allows for bottom entry of the line side conductors 240 (e.g., through a hole formed in the lower wall 26 beneath the plenum 230) while still isolating the line side conductors 240 from the second compartment 16 containing the fuses 42. Although only one line side conductor 240 is illustrated in FIG. 7, it will be appreciated that a plurality of line side conductors may extend through the plenum 230 and connect to the line side of the switch assembly 30.

Figure 8:
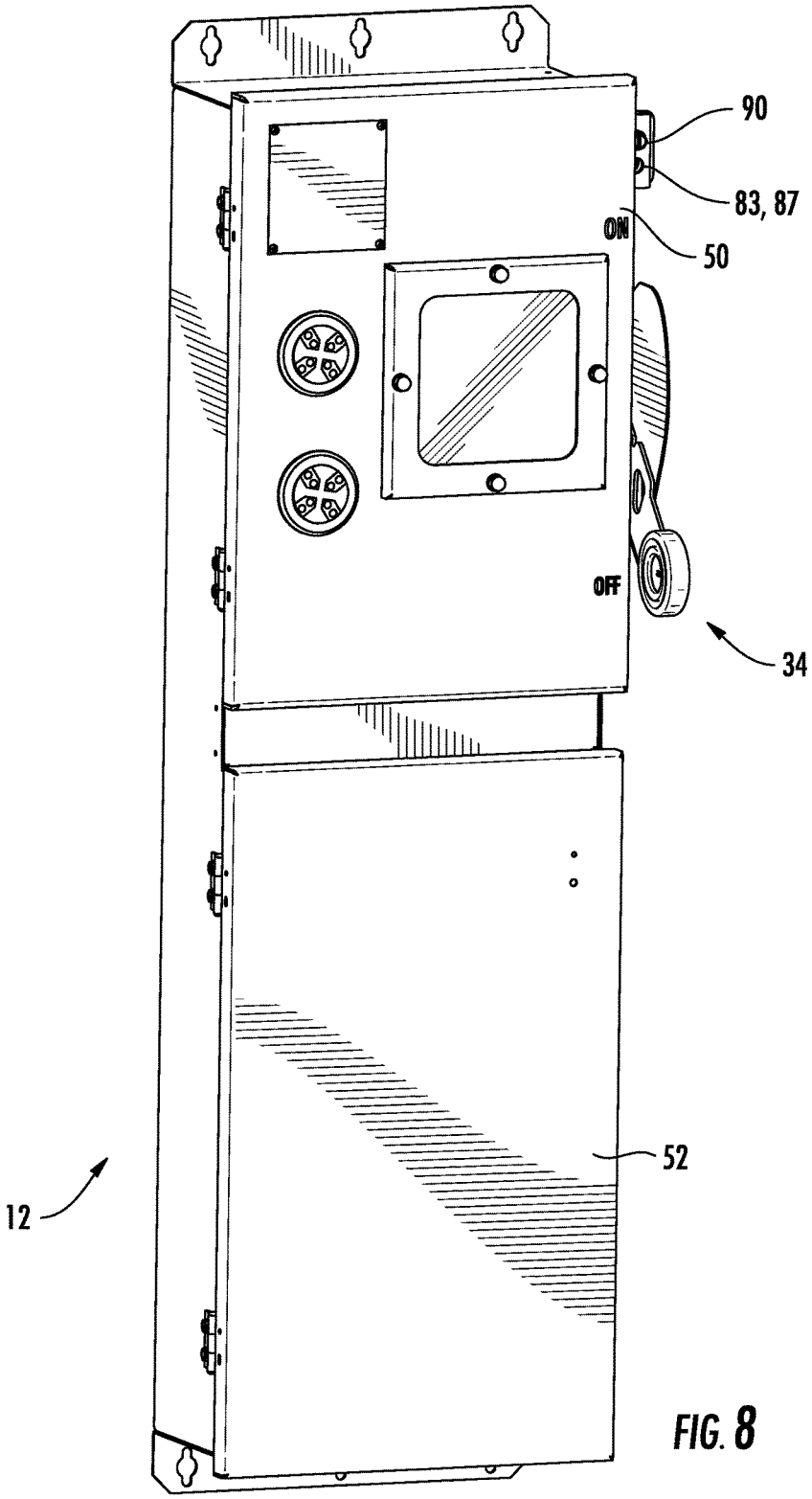
FIG. 8 is a front perspective view of the safety switch of FIG. 7 with the first and second doors in a closed position.
Figure 12:
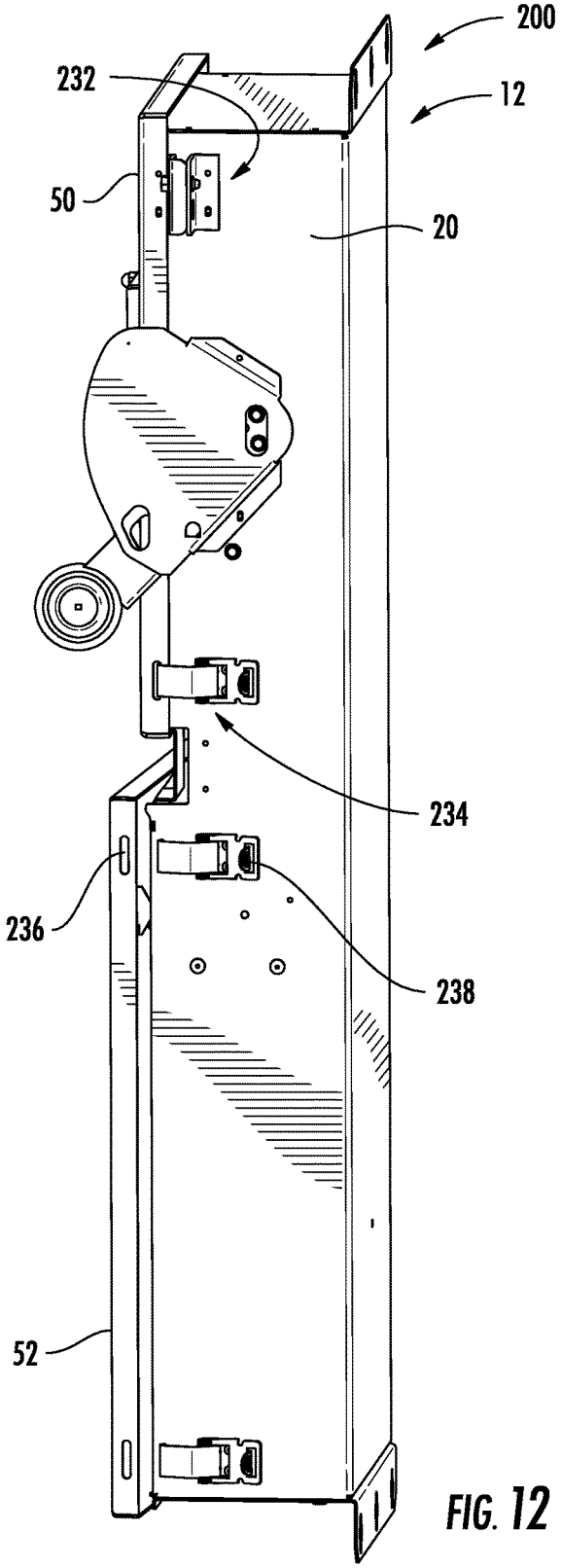
FIG. 12 is a side perspective view of the safety switch of FIG. 7 illustrating manual locking features.

Referring to FIGS. 7, 8 and 12, the safety switch may include one or more locking features for manually locking the first door 50 and/or the second door 52 in the closed position. For example, a screw-down locking feature 232 may be used. As described above, and referring to FIGS. 7 and 8, the tab 82 on the first door 50 may be mated with the tab 86 on the housing 12 so that the fastener 90 can be received in the aperture 88 of the tab 86 to lock the first door 50 in the closed position. The tabs 82, 86 may include aligned apertures 83, 87 though which a padlock or the like can be received.

Additionally or alternatively, clamps such as buckle clamps 234 may be on the sidewall 20 of the housing 12 and configured to engage slots 236 on the side of the first door 50 and/or the second door 52 to manually lock the door in the closed position. The clamp 234 may include a loop 238 to receive a padlock or the like.

The locking feature(s) may be used to prevent opening of the doors (for example, the one or more locking features may prevent a user from opening the first door 50). In addition, the locking feature(s) may help seal the compartments to help prevent debris such as dust or liquid from entering the compartments.

Known safety switches have the fuses in the same enclosure or compartment as the switch assembly. This presents a safety hazard because, even with the safety switch handle in the "OFF" position, the line side of the switch may not be disconnected from live voltage. Therefore, when a fuse opens and needs to be replaced, a user typically needs to put on protective gear, such as a hazard risk category (HRC) 4 arc flash suit, before opening the enclosure to replace the fuse. The arc flash suits introduce extra cost and can be inconvenient for the user. Alternatively, when a fuse needs to be replaced, an upstream (e.g., main) power source may be shut off. However, this effectively shuts down the entire facility or at least a portion thereof, and therefore introduces downtime and increased cost.

In contrast, embodiments of the present invention move the fuses to the second compartment so that they are separated from the line side conductors and switch assembly. A user that needs to replace a fuse may access the second compartment and the fuses in the manner described herein without being exposed to the first compartment that houses the line side conductors and the switch assembly. The barrier prevents the user from reaching up into the line side area of the switch assembly. This eliminates the need for protective gear and/or shutting down an upstream power supply.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A safety switch comprising:

a housing comprising first and second compartments that are separated by a barrier;

a switch mechanism and a switch assembly in the first compartment;

a plurality of fuses in the second compartment;

a plurality of conductors electrically connecting the switch assembly and the plurality of fuses, the plurality of conductors extending through at least one opening in the barrier;

a first door connected to the housing and covering the first compartment in a closed position;

a second door connected to the housing and covering the second compartment in a closed position;

a handle connected to the switch mechanism, the handle movable between an off position and an on position to operate the switch mechanism; and a locking mechanism operatively connected to the handle, the locking mechanism configured such that:

the second door is locked in the closed position when the handle is in the on position;

the second door is unlocked and movable from the closed position to an open position to expose the second compartment when the handle is in the off position;

the first door remains locked in the closed position when the handle is in the off position; and the handle is locked in the off position when the second door is in the open position.

2. A safety switch comprising:

a housing comprising first and second compartments that are separated by a barrier;

a switch mechanism in the first compartment;

a switch assembly comprising a plurality of contacts in the first compartment, wherein the switch mechanism is configured to open and close the contacts;

an enclosed plenum in the second compartment extending between a lower wall of the housing and the barrier, the plenum configured to receive line side conductors therethrough with the line side conductors extending through an opening in the barrier for connection to the switch assembly in the first compartment;

one or more fuse holders in the second compartment;

a first door connected to the housing and covering the first compartment;

a second door connected to the housing, the second door covering the second compartment in a closed position;

a handle connected to the switch mechanism, the handle movable between an off position and an on position; and a locking mechanism operatively connected to the handle, the locking mechanism configured such that:

the second door is locked in the closed position when the handle is in the on position;

the second door is movable from the closed position to an open position to expose the second compartment when the handle is in the off position; and the handle is locked in the off position when the second door is in the open position.

3. The safety switch of claim 2 further comprising:

one or more fuses in the second compartment and held by the one or more fuse holders; and one or more conductors electrically connecting the switch assembly and the one or more fuses, the conductors extending through at least one opening in the barrier.

4. The safety switch of claim 2 wherein the first door is locked in a closed position by a fastener and/or a clamp.

5. The safety switch of claim 2 wherein the second door covers the second compartment and the first door in the closed position.

6. The safety switch of claim 2 wherein:

the housing comprises a back wall, an upper wall, the lower wall, and opposite first and second sidewalls;

the first compartment is defined by the back wall, the upper wall, the barrier, and the first and second sidewalls; and the second compartment is defined by the back wall, the lower wall, the barrier, and the first and second sidewalls.

7. The safety switch of claim 6 wherein the first and second doors are pivotally connected to the first sidewall and the handle is connected to the second sidewall.

8. The safety switch of claim 2 wherein the locking mechanism comprises an elongated linkage operatively connected to the handle such that the linkage translates in response to movement of the handle.

9. The safety switch of claim 8 wherein the linkage extends through an opening in the barrier.

10. The safety switch of claim 8 wherein the linkage comprises first and second opposite ends, wherein the first end is operatively connected to the handle and the second end is received in a linkage receiving member in the second compartment when the second door is in the closed position and the handle is moved from the off position to the on position to thereby lock the second door in the closed position.

11. The safety switch of claim 10 wherein the linkage receiving member comprises a bracket having an aperture.

12. The safety switch of claim 11 wherein the bracket comprises a plate with the aperture defined in the plate, and wherein the second end of the linkage contacts the plate when the second door is in the open position and a user attempts to move the handle from the off position to the on position.

13. The safety switch of claim 11 wherein the bracket is spring-loaded and movable between a first position when the second door is in the closed position and a second position when the second door is in the open position.

14. The safety switch of claim 13 wherein:

the linkage defines a longitudinal axis;

the aperture is aligned with the longitudinal axis with the bracket in the first position; and the aperture is not aligned with the longitudinal axis with the bracket in the second position.

15. A method comprising:

providing a safety switch comprising:

a housing comprising first and second compartments that are separated by a barrier;

a switch mechanism in the first compartment;

a switch assembly comprising a plurality of contacts in the first compartment, wherein the switch mechanism is configured to open and close the contacts;

an enclosed plenum in the second compartment extending between a lower wall of the housing and the barrier, the plenum configured to receive line side conductors therethrough with the line side conductors extending through an opening in the barrier for connection to the switch assembly in the first compartment;

at least one fuse holder in the second compartment, the at least one fuse holder holding at least one fuse;

a handle coupled to the switch mechanism that is movable between an off position and an on position;

a first door coupled to the housing and covering the first compartment;

a second door coupled to the housing, the second door covering the second compartment in a closed position; and a locking mechanism in the housing and locking the second door in the closed position with the handle in the on position;

moving the handle from the on position to the off position with the second door in the closed position;

unlocking the second door in response to moving the handle from the on position to the off position;

opening the unlocked second door; and replacing the at least one fuse in the second compartment.

16. The method of claim 15 further comprising:

locking the handle in the off position in response to opening the second door.

17. The method of claim 15 further comprising, after replacing the at least one fuse:

closing the second door to the closed position;

moving the handle from the off position to the on position with the second door in the closed position; and locking the second door in the closed position in response to moving the handle from the off position to the on position.

18. The method of claim 17 wherein:

the locking mechanism comprises a linkage operatively connected to the handle and a linkage receiving member in the second compartment;

locking the second door in the closed position comprises receiving the linkage in the linkage receiving member in response to moving the handle from the off position to the on position; and unlocking the second door comprises withdrawing the linkage from the linkage receiving member in response to moving the handle from the on position to the off position.

19. The method of claim 18 wherein the linkage receiving member is movable between a first position and a second position, and wherein the linkage receiving member moves from the first position to the second position in response to opening the second door.

* * * * *